US005092260A

United States Patent [19]

Mardikian

[11] Patent Number: 5,092,260

[45] Date of Patent: Mar. 3, 1992

[54] PERSONAL WATERCRAFT WITH BRAKES

[75] Inventor: Albert Mardikian, Corona Del Mar, Calif.

[73] Assignee: Golden Empire Trading Co., Inc., Corona Del Mar, Calif.

[21] Appl. No.: 582,523

[22] Filed: Sep. 14, 1990

[51] Int. Cl.[5] ..... B63B 1/22

[52] U.S. Cl. ..... 114/285; 440/74; 114/270

[58] Field of Search ..... 114/284–285, 114/145 R, 145 A, 270

[56] References Cited

U.S. PATENT DOCUMENTS

| | | | |
|---|---|---|---|
| 3,058,442 | 10/1962 | Curtis | 114/285 |
| 3,435,795 | 4/1969 | Eckfield | 114/285 |
| 4,961,396 | 10/1990 | Sasagawa | 114/285 |

FOREIGN PATENT DOCUMENTS

| | | | |
|---|---|---|---|
| 282193 | 12/1986 | Japan | 114/286 |

*Primary Examiner*—Jesûs D. Sotelo
*Attorney, Agent, or Firm*—Klein & Szekeres

[57] ABSTRACT

A personal watercraft, such as a jet ski, is equipped with a hull, an engine and propulsion and a ride plate assembly attached to the bottom section of the hull. The ride plate assembly includes a fixed plate and a lower plate or flap hingedly mounted to the fixed plate to occupy continuously adjustable varying angular positions relative to the fixed plate. A manually operated control mechanism, controlled by an operator, adjusts the angular positioning of the flap within a predetermined range. It is an important characteristic of the continuously adjustable flap that within the range in which its angular positioning relative to the fixed plate and to the water can be changed, an initial and moderate change in angular positioning results in more hydrodynamic lift to act on the watercraft, and therefore in increased speed of the watercraft. However, beyond a certain value, further deflection of the flap results in significant braking action. In another embodiment of the watercraft of the invention braking of the watercraft is accomplished by mechanically braking the shaft which connects the engine with the propulsion. This is accomplished by placing mechanically or hydraulically actuated brake pads in operative engagement with the rotating shaft, or with a rotating disc fixedly mounted to the shaft. The brakes slow down rotation of the propulsion and therefore the entire watercraft, significantly faster than mere release of the throttle would, as it is done in the prior art.

5 Claims, 2 Drawing Sheets

FIG. 5
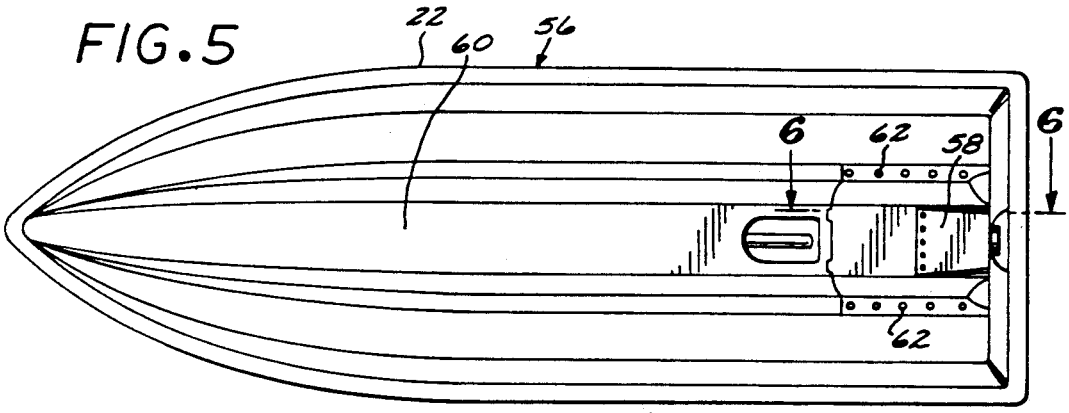
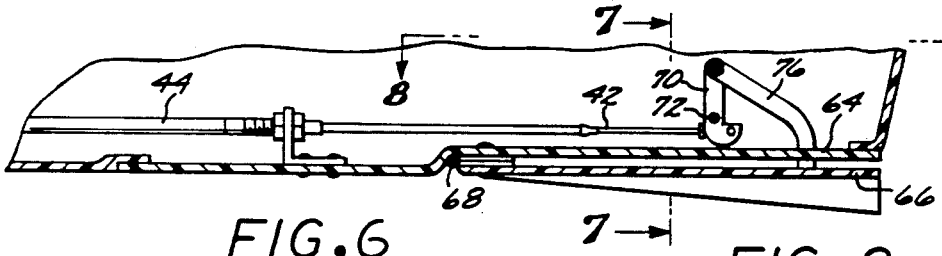
FIG. 6
FIG. 8
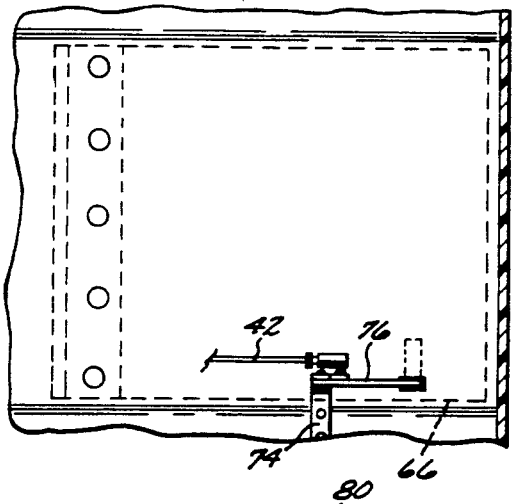
FIG. 7
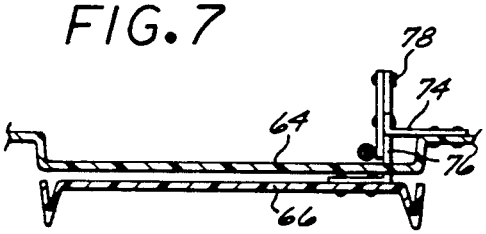
FIG. 9
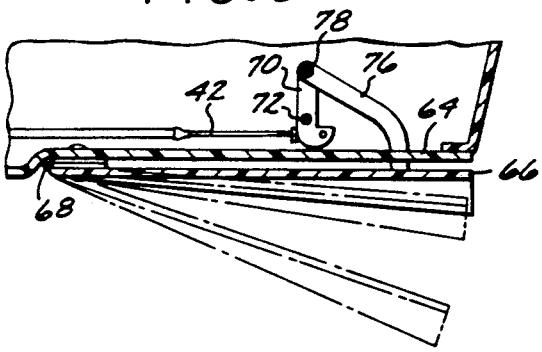
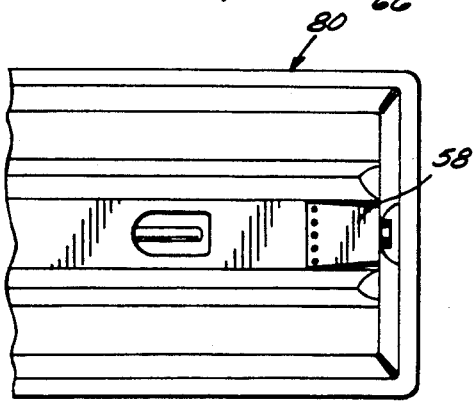
FIG. 10

PERSONAL WATERCRAFT WITH BRAKES

BACKGROUND OF THE INVENTION

1. Field of the Invention

The present invention is directed to recreational watercraft, primarily to the type of personal recreational watercraft which is commonly known as a jet ski. More particularly, the present invention is directed to recreational watercraft which is equipped with brakes to stopping or slowing down in anticipation of turning or for other reasons.

2. Brief Description of the Prior Art

Personal watercraft typically employ a jet pump for generating a directed rearward stream of water which provides the forward thrust required to propel the craft and its occupants. The direction of propulsion is controlled by the positioning of a movable steering nozzle which receives the stream of water from the pump and directs the flow so as to divide the thrust into the desired directional components. The positioning of the nozzle is affected by a steering cable system which connects the nozzle to a handlebar controlled by the driver of the watercraft. The handlebar typically includes a throttle control and an electrical on and off switch.

Although the steering assemblies and handlebars of conventional personal watercraft (jet skis) are non-adjustable and non-extendable, the inventor of the present invention has recently described in an application for United States Letters Patent, a personal watercraft where the handlebar is extendible to accommodate operator positions from a seated to an upright stance, and thereby provide improved performance and enhanced recreational experience.

Conventional personal watercraft includes a section of the lower part of the hull which is commonly referred to as the "ride plate". As is well known in the art, the ride plate is an important part of the watercraft in that when an operator is in a typical standing position on the watercraft traveling over water, the ride plate acts as a hydrofoil. Therefore, the shape and configuration of the ride plate affect the hydrodynamic forces acting on the watercraft, and therefore affect the watercraft's handling and performance.

Even though in typical recreational use personal watercrafts (jet skis) reach relatively high speeds over water, and from time to time may be involved in situations where rapid loss of speed or outright stopping is desired to avoid accidents or to execute sharp turns, as far as the present inventor knows no personal watercraft or jet ski of the prior art is equipped with brakes. Nor has the prior art provided, as far as the present inventor knows, a personal watercraft which has a mechanism for continuously adjusting, while the craft is in motion, the angle with which the ride plate hydrofoil meets the water. The present invention provides such personal watercraft with brakes, and in one aspect provides a continuously adjustable ride plate enabling a user to adjust, while the watercraft is in motion, certain operational characteristics of the craft.

SUMMARY OF THE INVENTION

It is an of the present invention to provide a personal watercraft, such as a jet ski, which has a brake to affect, when desired, rapid loss of speed of the craft on water.

It is another object of the present invention to provide a personal watercraft, such as a jet ski, where the angular positioning of a ride plate and thereby the hydrodynamic characteristics of the watercraft are continuously adjustable within a predetermined range while the craft is in motion.

The foregoing and other objects and advantages are attained by a personal watercraft equipped with a hull, an engine and propulsion means and a ride plate assembly attached to the bottom section of the hull. The ride plate assembly includes a fixed plate and a lower plate or flap hingedly mounted to the fixed plate to occupy continuously adjustable varying angular positions relative to the fixed plate. A manually operated control mechanism, controlled by the operator of the watercraft, adjusts the angular positioning of the flap within a predetermined range. It is an important characteristic of the continuously adjustable flap that within the range in which its angular positioning relative to the fixed plate and to the water can be changed, an initial and moderate change in angular positioning results in more hydrodynamic lift to act on the watercraft, and therefore in increased speed of the watercraft on water. However, beyond a certain value, further deflection of the flap results in significant braking action.

In another embodiment of the invention braking of the watercraft is accomplished by mechanically braking the shaft which connects the engine with the propulsion means. This is accomplished by placing mechanically or hydraulically actuated brake pads in operative engagement with the rotating shaft, or with a rotating disc mounted to the shaft. The brakes slow down rotation of the propulsion means and therefore slow down motion of the watercraft on water significantly faster than mere release of the throttle would, as it is done in the prior art.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 5 is a bottom plan view of a third preferred embodiment of the personal watercraft of the present invention;

FIG. 6 is a cross-sectional view, taken on lines 6,6 of FIG. 5, of the third preferred embodiment;

FIG. 7 is another cross-sectional view, taken on lines 7,7 of FIG. 6, of the third preferred embodiment;

FIG. 8 is a plan view, taken on lines 8,8 of FIG. 6, of the third preferred embodiment;

FIG. 9 is an enlarged side view, similar to FIG. 7, showing several positions of the angularly adjustable ride plate assembly of the third preferred embodiment, and FIG. 10 is a partial bottom plan view, similar to FIG. 5, of a fourth preferred embodiment.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Figure 1:
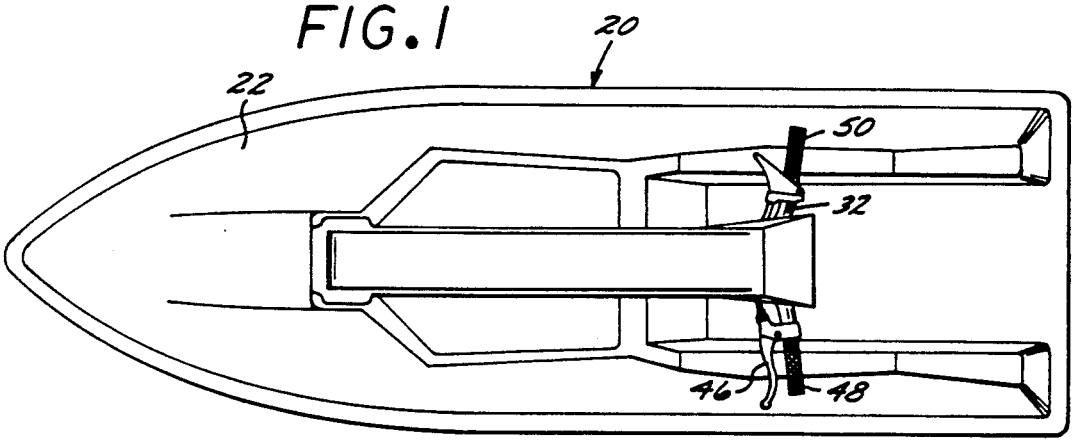
FIG. 1 is a top plan view of a personal watercraft in accordance with the present invention.
Figure 2:
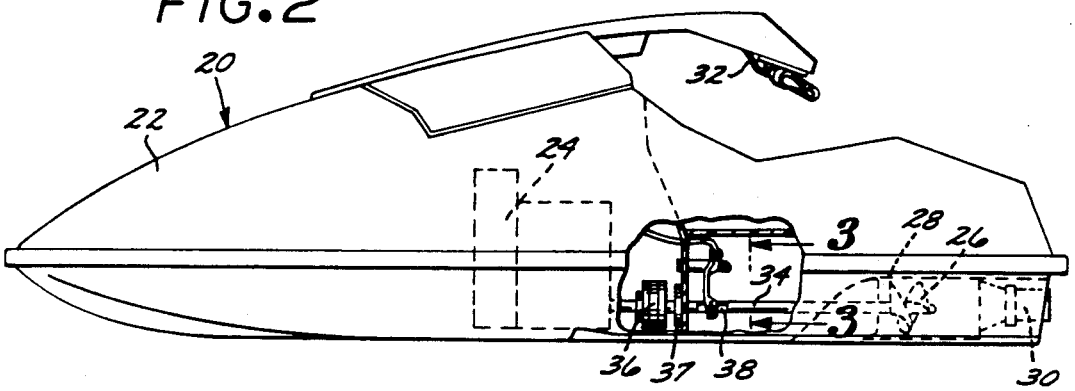
FIG. 2 is a side elevation of a first preferred embodiment of the personal watercraft of the invention, a portion of the hull being broken away.
Figure 3:
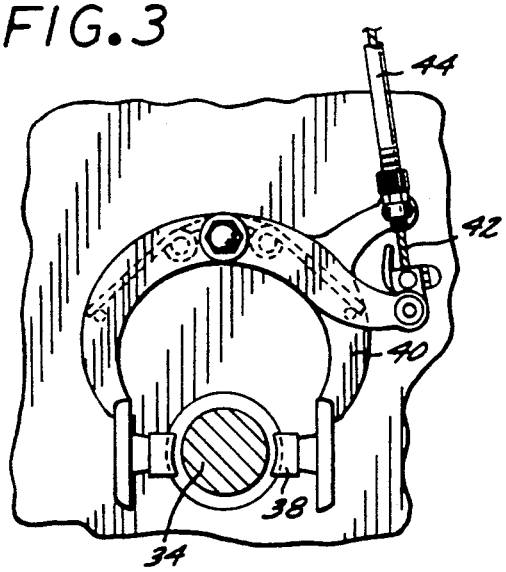
FIG. 3 is a rear view, taken on lines 3,3 of FIG. 2, of the braking mechanism of the first preferred embodiment.

Referring now to FIGS. 1 through 3 of the appended drawings, a first preferred embodiment 20 of the personal watercraft of the present invention is disclosed. It should be noted at the outset that whereas the watercraft schematically depicted in the drawing figures comprise jet skis, the invention is not limited to jet skis. Moreover, the basic design and construction of personal watercraft in general, and of jet skis in particular, are well known in the art, and therefore are described or mentioned in the present description only to the extent necessary in order to explain and highlight the novel features of the present invention.

Thus, the personal watercraft or jet ski which incorporates the present invention includes a hull 22, and an internal combustion engine 24 which drives a jet pump 26 or similar means for propulsion. The engine 24 and jet pump 26 are schematically shown on FIG. 2. The jet pump 26 includes a housing 28, and the craft is driven by water which is expelled from the housing 28 through a steering nozzle 30. The watercraft is steered by appropriately positioning (adjusting) the steering nozzle 30 so that water expelled from the nozzle 30 has the right directional component which propels the craft in the desired direction. Typically in jet skis the position of the steering nozzle 30 is controlled by the position of the handlebar 32 which is mechanically connected to the steering nozzle 30 and is normally grasped and held by the rider (not shown) while the craft is in motion. Thus the handlebar 32 is part of the steering mechanism. Because the feature of steering a personal watercraft, such as a jet ski, by adjusting the angular position of the steering nozzle 30 and the mechanism for accomplishing the same are well known in the art, the mechanism connecting the steering nozzle 30 to the handlebar 32 is not shown in the drawing figures and need not be described here.

A drive shaft 34, shown in the cut-away portion of FIG. 2, connects the engine 24 with the jet pump 26 through a coupling 36, which, per se, is conventional. FIG. 2 also shows a bearing 37 which supports the drive shaft 34. In accordance with the first preferred embodiment 20 of the present invention a brake pad 38 is mounted to engage the shaft 34 whenever braking action is desired. The brake pad 38 together with its cable controlled actuating caliper mechanism 40 is best shown in the enlarged view of FIG. 3. FIG. 3 shows one end of the cable 42 which is contained in a stationary cable housing 44, whereas the other end of the cable 42 is connected to a lever 46 mounted next to the right grip 48 of the handlebar 32. The left grip 50 of the handlebar 32 is rotatable and comprises in the herein described preferred embodiment a conventional control for the throttle (not shown) of the engine 24. Mechanical operation of the handlebar-mounted lever-actuated caliper brake, per se, is conventional, although its application to brake the drive shaft 34 of a personal watercraft is a novel feature of the present invention.

It should be readily apparent from the foregoing description and drawing figures that when the brake lever 46 is actuated by the operator (not shown) of the watercraft, the brake pads 38 engage and brake the rotating drive shaft 34, and thereby rapidly slow the rotation of the engine 24 and of the jet pump 26. As a consequence, the watercraft rapidly loses speed in the water, more rapidly than in like watercraft of the prior art, where, when stopping or slowing down are desired, in the absence of real brakes merely the throttle (not shown) can be closed by the operator (not shown). In this regard it is noted that when (as in the prior art) merely the throttle is closed (the engine is run in idle) to slow or stop the watercraft, the engine 24 and jet pump 26 still keep rotating at an enhanced rpm due to inertia, for sufficient time so as to make a difference in the braking or stopping ability of the watercraft of the prior art and that of the present invention.

Figure 4:
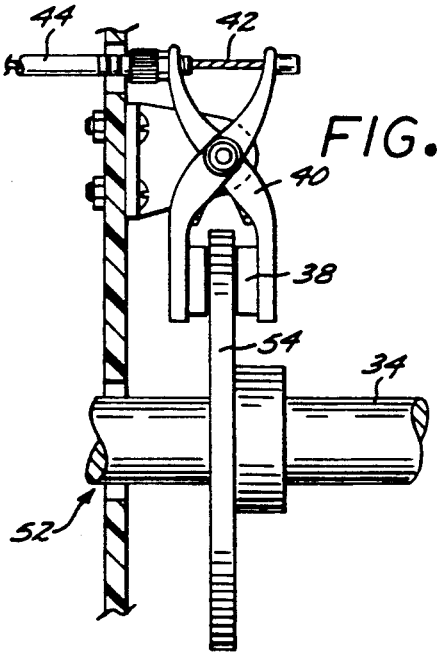
FIG. 4 is side view of the braking mechanism of a second preferred embodiment.

FIG. 4 shows a second preferred embodiment 52 of the present invention where a rotor or disc 54 is mounted on the drive shaft 34, and the caliper actuated brake pads 38 engage the rotor 54. It should be understood by those skilled in the art that the brakes of the first and second preferred embodiments need not necessarily be mechanically actuated, hydraulically actuated brakes (per se well known in the art) can also be used, although for personal watercraft mechanical brakes are preferred. It is a feature of the invention, however, that the brakes are preferably adjusted in such a manner that even when applied fully they do not slow the shaft 34 below the speed of rotation in idle, and therefore do not cause the engine 24 to stall.

Referring now to FIGS. 5 through 9 of the appended drawings, a third preferred embodiment 56 of the personal watercraft of the present invention is disclosed. In the third embodiment 56 a rider plate assembly 58 is provided toward the rear of a bottom plate 60 of the hull 22. The rider plate assembly 58 is constructed such that the angular positioning of the rider plate assembly 58 relative to the rest of the bottom plate 60 and the water can be continuously adjusted, and the rider plate assembly 58 can be sufficiently deflected so as to provide braking action.

More specifically, the rider plate assembly 58 of the third preferred embodiment 56 is designed to be mountable to existing commercially available personal watercrafts (jet skis) so as to replace the existing prior art rider plates thereon. Bolts which attach the rider plate assembly 58 of the present invention to the hull 22 of the personal watercraft are shown on FIG. 5 and bear the reference numeral 62.

The rider plate assembly 58 of the invention comprises a fixed plate 64 and a second plate 66 which is hingedly mounted to the fixed plate 64 to be capable of occupying varying angular positions relative to the fixed plate 64. A hinge assembly 68 mounting the second plate 66 to the fixed plate 64 is shown on FIGS. 6 and 9. The second plate 66 is also called a movable plate or flap 66.

Angular positioning of the movable plate or flap 66 relative to the rest of the assembly and relative to the water when the watercraft is in operation, is controlled by a mechanism which includes a member 70 pivotably mounted through a pivot pin 72 to a stationary angle iron 74 (shown in FIGS. 7 and 8), and an actuating member 76 mounted through a second pivot pin 78 to the member 70 and fixedly to the movable plate or flap 66. A control cable 42 which is housed in a stationary cable housing 44, is eccentrically mounted to the member 70. A second end of the cable 42 is attached to and controlled by the lever 46 which is mounted adjacent to the right grip 48 of the handlebar 32.

It should be readily apparent from the foregoing that the angular positioning of the movable plate or flap 66 can be influenced by the operator (not shown) of the personal watercraft through the control lever 46. Instead of the lever 46 a twistable grip on the right of the handlebar 32 (akin to the grip 50 which controls the throttle) may be used. Moreover, it will be readily apparent to those skilled in the art that the angular positioning of the movable plate or flap 66 affects the hydrodynamic characteristics of the watercraft. When the movable plate or flap 66 is fully retracted, as is shown for example on FIG. 6, the rider plate assembly 58 is substantially flat. Extending the movable plate or flap 66 to an intermediate extent (within its range of movement), as illustrated on FIG. 9, causes more hydrodynamic "lift", and the watercraft is able to move faster on the water than in a less deflected position of the flap 66. Beyond a certain value, however, further extension of the movable plate or flap 66 causes a significant braking action, resulting in rapid loss of speed or "braking" of the watercraft. The braking action caused by the fully, or almost fully, extended flap 66 is due to the increased friction of the flap 66 in the water and also to the fact that the fully, or almost fully, extended flap 66 causes the nose of the watercraft to penetrate deeper into the water whereby resistance to forward motion is increased still further. It will be readily understood by those skilled in the art that instead of a single movable plate or flap 66, several flaps may be provided in a personal watercraft built in accordance with the present invention.

FIG. 10 of the appended drawing figures illustrates a fourth preferred embodiment 80 of the present invention. The fourth preferred embodiment 80 differs from the third preferred embodiment principally in the feature that in the fourth preferred embodiment 80 the rider plate assembly 58 is not an "after market" replacement part, but rather is built together with the factory-built watercraft.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A personal watercraft comprising:

a hull including a bottom section having a ride plate assembly including a fixed plate and a movable flap mounted below the fixed plate for continuously adjustable angular positioning relative to the fixed plate, the movable flap acting as a hydrofoil during normal operation of the watercraft;

an engine connected to propulsion means incorporated in the watercraft for providing motive power to the watercraft;

means controllable by an operator of the watercraft while the watercraft is in motion, and operatively associated with the ride plate assembly for continuously adjusting the angle of the movable flap relative to the fixed plate and thereby adjusting the angle at which the movable flap meets the water, the movable flap also capable of acting as brakes for the watercraft, the means controllable by the operator for continuously adjusting the angle of the movable flap including a cable and cable control means manually handled by the operator;

a steering mechanism including a handlebar, the cable control means being mounted to the handlebar.

2. In a personal watercraft including a hull having a bottom section and an engine connected to propulsion means incorporated in the watercraft for providing motive power to the watercraft the improvement comprising:

a ride plate assembly mounted in the rear of the bottom section and comprising a fixed plate and a movable plate mounted below the fixed plate for continuously adjustable angular positioning relative to the fixed plate, the movable plate being thus adjustable in its angular positioning relative to the bottom section and relative to the water during normal operation of the watercraft, and means controllable by an operator of the watercraft for adjusting the angular positioning of the movable plate relative to the fixed plate, and a handlebar which is normally held by the operator during operation of the watercraft, and where the means for adjusting the angular positioning of the movable plate relative to the fixed plate are mounted to the handlebar, the movable plate also capable of acting as brakes for the watercraft.

3. In combination of a ride plate assembly and control means adapted to be incorporated into a personal watercraft which includes a hull having a bottom section, an engine connected to propulsion means incorporated in the watercraft for providing motive power to the watercraft, and a handlebar normally held by an operator during normal operation of the watercraft, the ride plate assembly being mounted to the bottom section of the hull and comprising:

a fixed plate and a movable plate mounted below the fixed plate for continuously adjustable angular positioning relative to the fixed plate, the movable plate being thus adjustable in its angular positioning relative to the bottom section and relative to the water during normal operation of the watercraft and thereby comprising an adjustable hydrofoil, and the control means comprising a cable and cable actuating means controllable by the operator, the cable being mounted to the movable plate and to the handlebar whereby the operator can manually adjust the angular positioning of the movable plate while the operator holds the handlebar.

4. The invention of claim 3 where the movable plate is mounted to the fixed plate with a hinge.

5. The invention of claim 3 where the cable actuating means include a lever squeezable by the operator.

* * * * *

UNITED STATES PATENT AND TRADEMARK OFFICE

CERTIFICATE OF CORRECTION

PATENT NO. : 5,092,260

DATED : March 3, 1992

INVENTOR(S) : Albert Mardikian

It is certified that error appears in the above-identified patent and that said Letters Patent is hereby corrected as shown below:

Column 1, line 11, before "stopping" add —facilitate—;

Column 1, line 64, after "an" insert —object—.

Signed and Sealed this

Sixteenth Day of August, 1994

*Attest:*

BRUCE LEHMAN

*Attesting Officer*

*Commissioner of Patents and Trademarks*